US006928362B2

(12) United States Patent
Meaney

(10) Patent No.: US 6,928,362 B2
(45) Date of Patent: Aug. 9, 2005

(54) SYSTEM AND METHOD FOR REAL TIME PROGRAMMABILITY OF AN ENGINE CONTROL UNIT

(76) Inventor: John Meaney, 4352 Fenton Rd., Hartland, MI (US) 48353-1402

( * ) Notice: Subject to any disclaimer, the term of this patent is extended or adjusted under 35 U.S.C. 154(b) by 0 days.

(21) Appl. No.: 10/860,971

(22) Filed: Jun. 4, 2004

(65) Prior Publication Data

US 2004/0249558 A1 Dec. 9, 2004

Related U.S. Application Data

(60) Provisional application No. 60/476,789, filed on Jun. 6, 2003.

(51) Int. Cl.[7] ..... F02D 45/00
(52) U.S. Cl. ..... 701/115
(58) Field of Search ..... 701/115; 73/119 A; 711/100, 101, 103

(56) References Cited

U.S. PATENT DOCUMENTS

| | | | | |
|---|---|---|---|---|
| 5,091,858 A | | 2/1992 | Paielli | 364/431.12 |
| 5,697,339 A | * | 12/1997 | Esposito | 123/357 |
| 5,835,706 A | | 11/1998 | Hikichi et al. | 395/185.02 |
| 6,127,947 A | | 10/2000 | Uchida et al. | 340/999 |
| 6,138,059 A | | 10/2000 | Ozeki et al. | 701/1 |
| 6,144,887 A | | 11/2000 | Kamiya et al. | 700/79 |
| 6,272,587 B1 | | 8/2001 | Irons | 711/103 |
| 6,430,716 B1 | | 8/2002 | Hiramatsu | 714/718 |
| 6,535,811 B1 | | 3/2003 | Rowland et al. | 701/115 |
| 6,643,572 B2 | | 11/2003 | Kohge et al. | 701/41 |

* cited by examiner

*Primary Examiner*—Hieu T. Vo
(74) *Attorney, Agent, or Firm*—Howard & Howard

(57) ABSTRACT

A method for real time programmability of an engine electronic control unit (ECU). The present invention allows a user to update calibration data previously stored in memory in the engine ECU with new calibration data sent from an external device. The user can monitor the effects of the new calibration data on the engine instantaneously without having to wait for a period of time for the new calibration data to be permanently stored in the engine ECU's memory. To permanently store the new calibration data into the main memory, an erase/reprogram subroutine is uploaded from the main memory to a temporary memory. After the erase/reprogram subroutine is uploaded into the temporary memory location, the erase/reprogram subroutine will execute and permanently download the new calibration data into the main memory in response to a predetermined vehicle event.

10 Claims, 3 Drawing Sheets

SYSTEM AND METHOD FOR REAL TIME PROGRAMMABILITY OF AN ENGINE CONTROL UNIT

RELATED APPLICATIONS

This application claims the benefit of U.S. Provisional Application No. 60/476,789, filed Jun. 6, 2003.

BACKGROUND OF THE INVENTION

1. Field of the Invention

The present invention relates to a method for permanently loading calibration data into a flash memory for electronic control of an engine. More specifically, the present invention allows a user the ability to immediately assess engine performance when new calibration data has been loaded into an engine electronic control unit. Additionally, the method provides for a permanent means of storing the new calibration data from RAM into flash memory by monitoring vehicle level inputs signals.

2. Description of the Related Art

Modern day fuel injected fuel engines are controlled by an electronic control unit (ECU). The ECU is a computer that executes a program which controls various engine outputs in response to vehicle level input signals. The ECU contains a microcontroller which further comprises of a memory and a plurality of input or output pins. The memory is placed either external or internal to the microcontroller. The memory is connected to the microcontroller through address or data buses where data is communicated between the microcontroller and memory. The number of input or output pins located on the ECU depends on the vehicle line or engine type involved. The input and output pins are connected to various key components related to the operation of the engine and comprises of either analog or digital signals.

The main software control program or executable code is stored in a fixed memory device and typically consists of one of the following types; a UV erasable programmable read only memory (EPROM), a read only memory (ROM), an electrically erasable programmable read only memory (EEPROM), and more recently the use of a flash memory. The fixed memory devices are non-volatile meaning that the data stored is not lost when power is removed from the ECU. Depending on the fixed memory type used, a fixed memory device can be reprogrammed to accept a new software control program. A temporary memory location such as a random access memory (RAM) is used to store dynamic variables and for performing calculations. RAM is volatile, meaning it loses its data when power is removed from the engine ECU.

The prior trend in ECU's designs was to use EEPROM's for storing engine calibration data. The calibration data comprises of data used to control emissions, engine performance, drivability and fuel consumption. The EEPROM was preferred because it could be erased and reprogrammed byte wide many times. If a single calibration needs to be changed, it can be erased and reprogrammed without erasing and reprogramming the entire memory.

Typically, when erasing and reprogramming the EEPROM, the main software control program executes a subroutine located within the program that would erase the contents in the EEPROM in a background loop while the engine was running. While in the reprogramming mode, access to the EEPROM was prohibited, as a result, a user reprogramming the EEPROM would have to wait for the reprogramming procedure to terminate. Once the reprogramming procedure was complete, the main software control program was allowed to access the EEPROM again and only then could the user assess the impact of the new calibration data with respect to engine functionality. The problem with erasing and reprogramming the EEPROM was that the process slow and it increased development time. Additionally, the costs of using EEPROM's were becoming prohibitive when compared to the cheaper costs associated with using flash memory. With flash memory, memory storage capability is increased dramatically. It is no longer unheard of for a programmer to find a microcontroller having a flash memory which allows for data storage in excess of eight megabytes. Likewise, RAM packaged with microcontrollers which are equipped with flash memory will allow for data storage of up to several kilobytes of data if needed.

Although the use of flash memory in engine ECU's provides commercial benefits in addition to increased data storage capacity, there are some drawbacks. The problem with flash memory, particularly for flash memory packaged external to the microcontroller, is that a single value located in the calibration data cannot be erased and reprogrammed one byte at a time. If flash memory is used, the entire memory sector has to be first erased then reprogrammed. As a result, a user would have to wait for the erase/reprogram operation to be completed. This delay prevents the user from immediately assessing engine performance when new changes are made to calibration data.

The objective of the present invention is to capitalize on the benefits associated with using flash memory on engine ECU's and to also provide the user with the capability of immediately assessing engine performance when a new calibration data has been downloaded into an ECU.

BRIEF SUMMARY OF THE INVENTION AND ADVANTAGES

The objective of the present invention is to allow a user to instantaneously assess engine performance when new calibration data is downloaded into an engine ECU. The engine ECU comprises of two memory storage devices. The first memory storage device is the flash memory or main memory, and it includes both a main software control program and calibration data. The main software control program and calibration data are stored in a plurality of sectors disposed within memory locations in the flash memory. The second memory storage device is RAM, which serves as a temporary memory location and it is utilized to store temporary data. On engine startup, the ECU runs an initialization routine and sends the calibration data to RAM where the calibration data interfaces with the main software control program. By interfacing the calibration data with the main software control program, the engine ECU is able to monitor and operate various functions related to the engine.

New calibration data can be inserted into the engine ECU through the use of an external device which is compatible with the ECU for sending calibration data. Generally, a personal computer is used to send the calibration data, however various types of hand held diagnostic tools may be used for sending new calibration data. An RS-232 serial communications link is connected between the personal computer and the engine ECU. The user modifies the calibration data through a user interface on a personal computer where the data is sent to the engine ECU. The new calibration data is uploaded into the RAM of the engine ECU where it interfaces with the main software control program and immediately allows the user to monitor the impact of the new calibration data with respect to engine control. Once the desired function or desired engine control is achieved, the next step is to permanently store the new calibration data in the flash memory. The ECU monitors the ignition line input to detect a specific voltage range. Once the corresponding voltage has been detected by the ECU, an erase/reprogram subroutine which was part of the main software control program is uploaded from flash memory into RAM. After uploading the erase/reprogram subroutine into RAM, the erase/reprogram subroutine is executed from RAM where it erases the previously stored calibration data and reprograms the new calibration data into the corresponding sectors of the flash memory. The motivation for utilizing the erase/reprogram subroutine is to compensate for the limitations associated with using external flash. Primarily, the limitation of not being able to execute code out of one sector when data in another sector is being replaced and reprogrammed with new data.

The present method allows a user to continuously modify the calibration data until the desired engine control is achieved without having to wait for a permanent download of the new calibration data into the flash memory. The invention as described provides a significant advantage for users because of the flexibility offered in modifying calibration data. It allows users to make changes in a shorter amount of time which reduces overall development time. Additionally, the present invention requires less software overhead, eliminates additional components and requires no special memory to execute.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
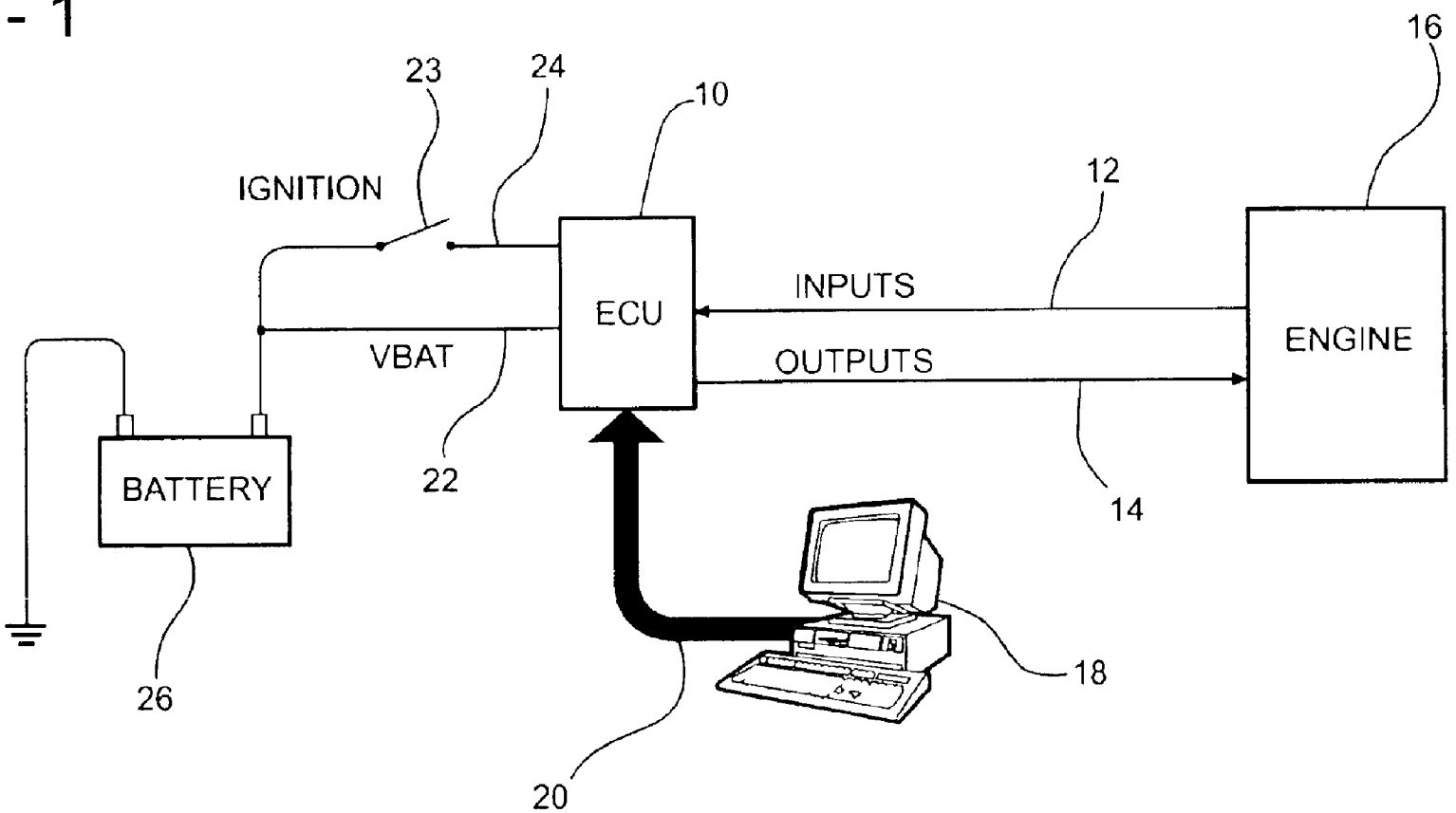
FIG. 1 is a block diagram of an engine ECU system according to the embodiment of the present method.

Referring to FIG. 1, an engine ECU 10 has a plurality of inputs 12 and outputs 14 which are connected to various electrical components disposed within an engine compartment 16. The plurality of inputs 12 comprises of data received from various sensors for providing feedback to the engine ECU 10. Likewise, the plurality of outputs 14 from the engine ECU 10 comprises of data for operating fuel injector drivers, ignition coils, cooling fans, or fuel pumps. The plurality of inputs 12 and outputs 14 are electrical signals that are either analog or digital. The engine ECU 10 is connected directly to a battery 26 through a Vbatt input 22 for powering the engine ECU 10. Under normal conditions, a battery voltage feed 22 of twelve volts is used to power the engine ECU 10. An ignition line feed 24 is run directly from an ignition switch 23 to the engine ECU 10. It is necessary for the engine ECU 10 to monitor the ignition line 24 feed to determine whether the engine is in the "Off", "Run" or "Start" position.

The engine ECU 10 has the capability of receiving new calibration data from an external device or personal computer (PC) 18. A user can upload new calibration data from the personal computer 18 into the engine ECU 10 for modifying or varying various engine ECU controls. The new calibration data is sent from the PC 18 to the engine ECU 10 via a communication link 20 or more specifically a RS-232 serial connection. The PC 18 and the engine ECU 10 share a common protocol which is designed to allow the new calibration data to be sent from the PC 18 and received by the engine ECU 10. In first updating the calibration data in the PC 18, the user would input the desired value or set of values in a calibration table. The PC 18 sends and encodes a sequence of bytes which correspond to the new calibration data. The engine ECU 10 receives and then decodes the encoded data.

Figure 2:
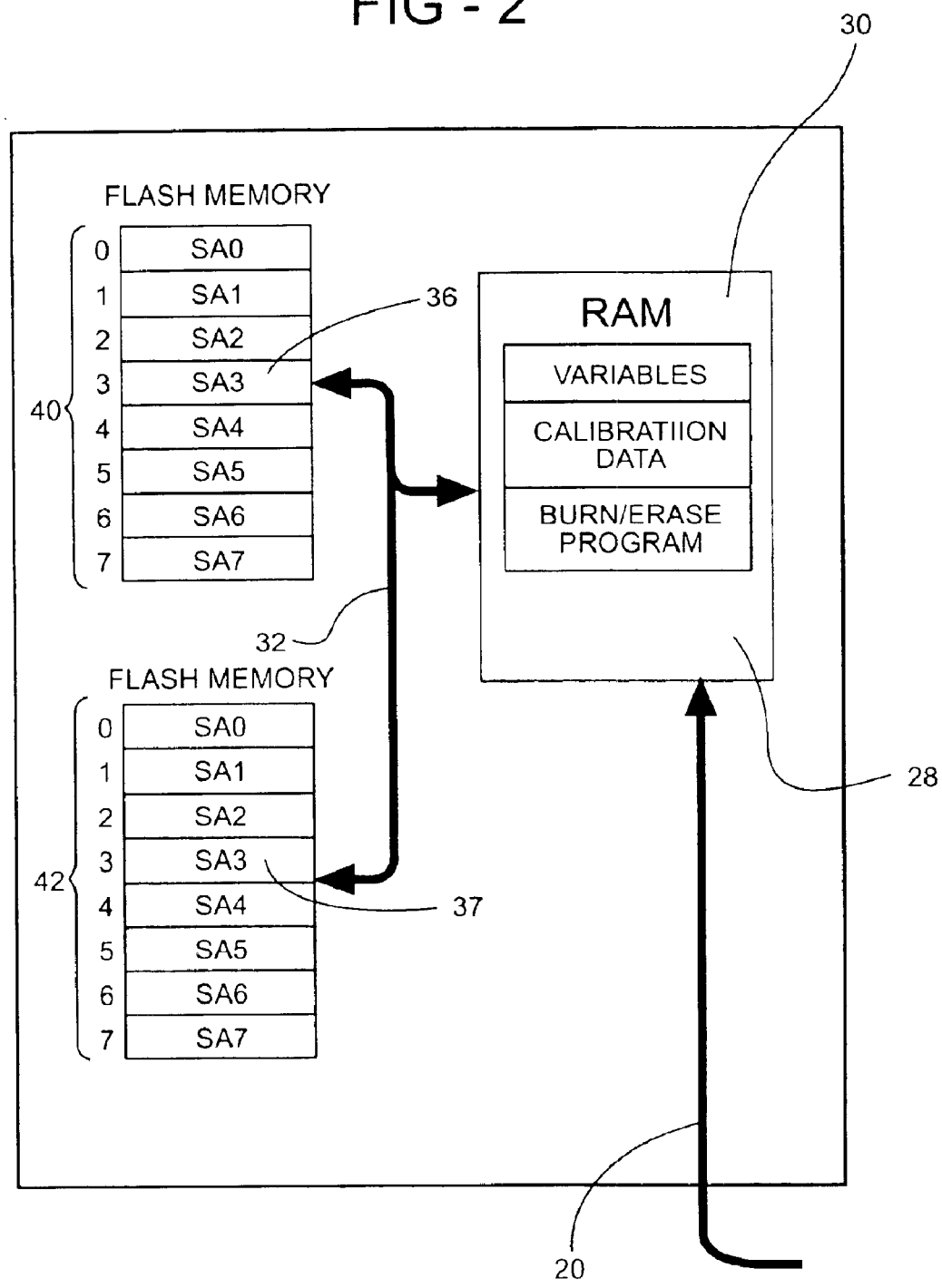
FIG. 2 is a block diagram of an engine ECU which illustrates the relationship between a flash memory and RAM memory device.

Referring to FIG. 2, the decoded data or new calibration data is stored in RAM 30. In addition to storing the new calibration data, the RAM 30 disposed within a microcontroller 28 would store variables and an erase/reprogram subroutine. The data used to comprise the main software control program is stored in a plurality of memory locations 40, 42 in flash memory. Various flash memory packages are broken into 2–4K, 8K, 16K, 32K, 64K, 256K, and 512K sectors. Typically, for an automotive engine ECU 10, the calibration data is kept in smaller sectors ranging from 4 to 8K sectors while the main software control program is stored in larger sectors of 256K and up. The preferred embodiment would follow a similar format wherein the calibration data would be stored in smaller size sectors and the main software control program would be stored into larger sectors of the memory locations 40, 42. Additionally, the flash memory would be packaged external to the microcontroller. However, the method as described should not be limited to external flash memory and may include flash memory packaged internally with microcontrollers which allows for executing the main software program while reprogramming new calibration data into one or more other sectors disposed within the memory locations 40, 42.

Although FIG. 2 only shows only two (8-bit) memory locations 40, 42, the present embodiment utilizes a plurality of memory locations 40, 42 for storing the main software control program and calibration data. Each memory location 40, 42 comprises of eight sectors for storing eight bits of data or one byte of data for each memory location 40, 42. Accordingly, for both memory locations 40, 42, a total of two bytes of data can be stored. Data is sent from flash memory to RAM via an address/data bus 32 which can come in an 8, 16, or 32 bit size.

Figure 3:
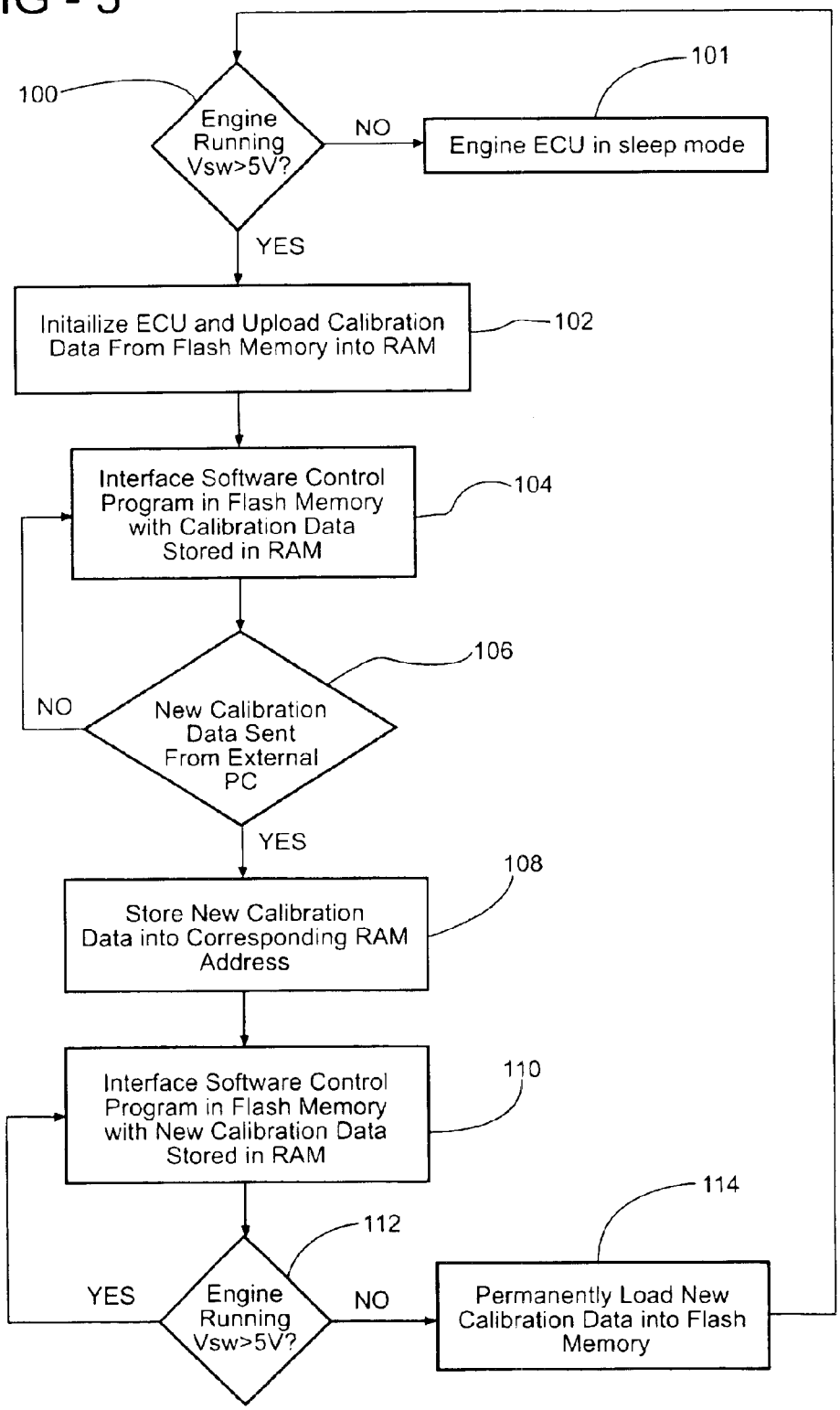
FIG. 3 is a flow chart of a method for programming calibration data for an engine ECU.

Referring to FIGS. 2–3, the method begins in step 100, the engine ECU 10 monitors the ignition line input 24. If the ignition line input 24 is below 5 volts, the ignition switch 23 is in an open state with a corresponding engine status of being in off, the method will stay in step 101 where the engine ECU will remain in sleep mode. To complete step 100 and to get to step 102, the ignition switch 23 would be in the closed position indicating that the engine is either in Run or Start. When in Run or Start, the corresponding voltage on the ignition input line 24 would be greater than 5 volts. While in step 102, the engine ECU 10 will initialize and upload the calibration data from flash memory into the RAM 30.

In step 104, the main software control program stored in flash memory would interface with the calibration data stored in RAM for controlling the engine. In step 106, if new calibration data was sent from an external device or PC 18, the method would move onto step 108 where the new calibration data would be stored in RAM 30. If the new calibration data was not sent from an external device 18, the method would stay in step 104 where the main software control program in the flash memory would continue to interface with the calibration data initially stored in RAM 30.

In step 110, the main software control program in the flash memory interfaces with the new calibration data stored in the RAM 30 for operating the engine in accordance with the new parameters as set forth by the user. The next step is to permanently store the new calibration data into the flash memory. In step 112, the engine ECU continuously polls the ignition input line to check engine status. If the engine remains running, the main software control program will continue to interface with the new calibration data stored in RAM. If on the other hand, while polling the ignition level input, a voltage of 5 volts or less is detected by the engine ECU 10, the method moves to step 114. After a voltage of 5 volts or less is detected by the engine ECU 10, the erase/reprogram subroutine that is currently stored in the flash memory, is uploaded into RAM and then executed for permanently downloading new calibration data into the flash memory.

By executing the erase/reprogram program, the old calibration data is erased and the new calibration data is stored into sector (SA3) 36 in the first memory location 40 and sector (SA3) 37 in the second memory location 42. After step 114 is complete, the method returns to step 100 where the engine ECU remains in sleep mode until a voltage level of greater than 5 volts is detected again by the engine ECU 10. The method allows for reprogramming new calibration data into flash memory an infinite amount of times.

Obviously, many modifications and variations of the present invention are possible in light of the above teachings. The invention may be practiced otherwise than as specifically within the scope of the appended claims.

What is claimed is:

1. A method of updating calibration data for an engine electronic control unit having a main software control program and the calibration data for providing electronic control signals to an engine, said method comprising the steps of:

storing the main software control program and the calibration data in a main memory disposed within the electronic control unit;

uploading the calibration data from the main memory to a temporary memory location disposed within the electronic control unit;

replacing the calibration data in the temporary memory location with a new calibration data;

running the main software control program from the main memory with the new calibration data stored in the temporary memory location;

uploading a portion of the main software control program from the main memory to the temporary memory location; and executing the portion of the main software control program from the temporary memory location to download the new calibration data from the temporary memory location into the main memory.

2. A method as set forth in claim 1 wherein the step of executing the portion of the main software control program from the temporary memory location further includes triggering the execution of the portion of the main software control program in response to a predetermined event.

3. A method as set forth in claim 2 wherein the step of triggering the execution of the portion of the main software control program in response to a predetermined event is further defined as detecting an ignition line input for a specified voltage level of between 0 to 5 volts.

4. A method as set forth in claim 1 wherein the step of executing the portion of the main software control program is further defined as storing the new calibration data into at least one sector of the main memory.

5. A method as set forth in claim 1 wherein the step of storing the main software control program and the calibration data in a main memory is further defined as storing the main software control program and the calibration data in a flash memory.

6. A method as set forth in claim 1 wherein the step of replacing the calibration data in the temporary memory location with new calibration data is further defined as receiving the new calibration data from an external device.

7. A method of updating a calibration data from an engine electronic control unit having a flash memory storing a main software control program and storing calibration data for providing electronic control signals to an engine, said method comprising the steps of:

uploading the calibration data from the flash memory to a RAM memory disposed within the electronic control unit;

replacing the calibration data in the RAM memory with a new calibration data received from an external device;

running the main software control program from the flash memory with the new calibration data stored in the RAM memory;

uploading an erase/reprogram subroutine from the flash memory to the RAM memory; and executing the erase/reprogram subroutine from the RAM memory to download the new calibration data from the RAM memory into the flash memory.

8. A method as set forth in claim 7 wherein the step of replacing the calibration data in the RAM memory with new calibration data received from an external device is further defined as sending new calibration data from a computer having a protocol to communicate with the engine electronic control unit.

9. A method as set forth in claim 7 wherein the step of executing the erase/reprogram subroutine from the RAM memory is further defined as triggering the execution of the burn erase/reprogram program in response to a predetermined event.

10. A method as set forth in claim 9 wherein the step of triggering the execution of the burn erase/reprogram upon a predetermined event is further defined as detecting an ignition line input for a specified voltage level of between 0 to 5 volts.

* * * * *